US011804349B2

(12) United States Patent
Ladkat et al.

(10) Patent No.: US 11,804,349 B2
(45) Date of Patent: Oct. 31, 2023

(54) CIRCUIT INTERRUPTER

(71) Applicant: EATON INTELLIGENT POWER LIMITED, Dublin (IE)

(72) Inventors: Ashwini Ladkat, Pune (IN); Karthik Satyanarayanan, Vellore (IN); Ravindra Kumar Soni, Jhunjhunu (IN); Jeffrey Michael Cox, Venetia, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 119 days.

(21) Appl. No.: 17/471,481

(22) Filed: Sep. 10, 2021

(65) Prior Publication Data

US 2023/0084420 A1 Mar. 16, 2023

(51) Int. Cl.

| | |
|---|---|
| ***H01H 71/04*** | (2006.01) |
| ***H01H 9/16*** | (2006.01) |
| ***H01H 9/20*** | (2006.01) |
| ***H01H 9/02*** | (2006.01) |

(52) U.S. Cl.

CPC ..... *H01H 71/04* (2013.01); *H01H 9/0271* (2013.01); *H01H 9/16* (2013.01); *H01H 9/20* (2013.01); *H01H 2071/042* (2013.01)

(58) Field of Classification Search

CPC ..... H01H 2071/10; H01H 2071/009; H01H 2071/12; H01H 2205/024; H01H 2221/00; H01H 2221/016; H01H 2235/00; H01H 2235/004; H01H 2235/006; H01H 2235/03; H01H 1/00; H01H 1/22; H01H 1/24; H01H 1/221; H01H 1/225; H01H 1/226; H01H 1/50; H01H 3/62; H01H 73/00; H01H 73/02; H01H 2001/50; H01H 2009/0278; H01H 2009/0292; H01H 71/523; H01H 71/524; H01H 71/00; H01H 71/02; H01H 71/0271; H01H 71/10; H01H 71/1045; H01H 71/52; H01H 71/521; H01H 71/522; H01H 71/526; H01H 71/528; H01H 9/00; H01H 9/02; H01H 9/0271; H01H 9/16; H01H 9/20; H01H 2071/00; H01H 2071/04; H01H 2071/042; H01H 71/04

See application file for complete search history.

(56) References Cited

U.S. PATENT DOCUMENTS 3,662,134 A * 5/1972 Cellerini ..... H01H 1/226 218/21

2004/0065531 A1* 4/2004 Richter ..... H01H 71/1009 200/15

* cited by examiner

*Primary Examiner* — Anthony R Jimenez

(74) *Attorney, Agent, or Firm* — Eckert Seamans Cherin & Mellott, LLC

(57) ABSTRACT

A circuit interrupter movable among ON, OFF, and TRIP positions includes a housing, a latch situated on the housing, a number of mechanisms situated on the housing, each mechanism of the number of mechanisms including a contact arm that is movable with respect to the housing, a set of separable contacts including a stationary contact and further including a movable contact situated on the contact arm, a handle, a pin, a first spring that extends between the contact arm and the handle in at least one of the OFF position and the ON position, a second spring that extends between the handle and the pin, and the pin being movable among a position engaged with the latch in at least one of the ON position and the OFF position and another position engaged with the handle in the TRIP position.

18 Claims, 18 Drawing Sheets

CIRCUIT INTERRUPTER

BACKGROUND

Field

The disclosed concept relates generally to a circuit interrupter and, more particularly, to a circuit interrupter that is movable between an ON position, an OFF position, and a TRIP position, and that has a TRIPFREE function and position.

Related Art

Numerous types of circuit interruption devices, including circuit interrupters, are known to exist for use in interrupting current in various overcurrent, under-voltage, and other conditions. It is known, however, that certain known circuit interruption devices can be difficult to use due to the forces that are required in moving the circuit interruption device among the ON position and the OFF position, for instance. Moreover, certain known circuit interruption devices have caused difficulties when attempting to access a calibration screw that is placed in a location that is difficult to access. Thus, there is room for improvement in circuit interruption devices.

SUMMARY

These needs and others are met by embodiments of the invention, which are directed to an improved circuit interrupter.

As one aspect of the disclosed and claimed concept, an improved circuit interrupter movable among an ON position, an OFF position, and a TRIP position can be generally stated as including a housing, a latch situated on the housing, a number of mechanisms situated on the housing, each mechanism of the number of mechanisms can be generally stated as including a contact arm that is movable with respect to the housing, a set of separable contacts that can be generally stated as including a stationary contact and further generally stated as including a movable contact situated on the contact arm, a handle, a pin, a first spring that extends between the contact arm and the handle in at least one of the OFF position and the ON position, a second spring that extends between the handle and the pin, and the pin being movable among a position engaged with the latch in at least one of the ON position and the OFF position and another position engaged with the handle in the TRIP position. As employed herein, the expression "a number of" and variations thereof shall refer broadly to any non-zero quantity, including a quantity of one.

As another aspect of the disclosed and claimed concept, an improved circuit interrupter movable among an ON position, an OFF position, and a TRIP position can be generally stated as including a housing, a latch situated on the housing, a number of mechanisms situated on the housing and cooperable with the latch to move the circuit interrupter from the ON position to the TRIP position, each mechanism of the number of mechanisms can be generally stated as including a contact arm that is movable with respect to the housing, a set of separable contacts that can be generally stated as including a stationary contact and further generally stated as including a movable contact situated on the contact arm, a spring connected with the contact arm, and a handle that can be generally stated as including a pin with which the spring is further connected, the handle further can be generally stated as including a member having formed therein a slot that is elongated and that includes a notch, the pin being situated in the slot, the pin being biased by the first spring into the notch in the OFF position and the ON position.

As still another aspect of the disclosed and claimed concept, an improved circuit interrupter movable among an ON position, an OFF position, and a TRIP position, can be generally stated as including a housing, a latch situated on the housing, a pair of mechanisms situated on the housing, each mechanism of the pair of mechanisms can be generally stated as including a contact arm that is movable with respect to the housing, a set of separable contacts that can be generally stated as including a stationary contact and further can be generally stated as including a movable contact situated on the contact arm, a handle, and a spring that extends between the contact arm and the handle in at least one of the OFF position and the ON position, the housing having a seat formed therein between the pair of mechanisms, and the latch having a base, the base being movably received in the seat.

BRIEF DESCRIPTION OF THE DRAWINGS

A full understanding of the disclosed concept can be gained from the following Description when read in conjunction with the accompanying drawings in which.

Similar numerals refer to similar parts throughout the Specification.

DESCRIPTION

Figure 1:
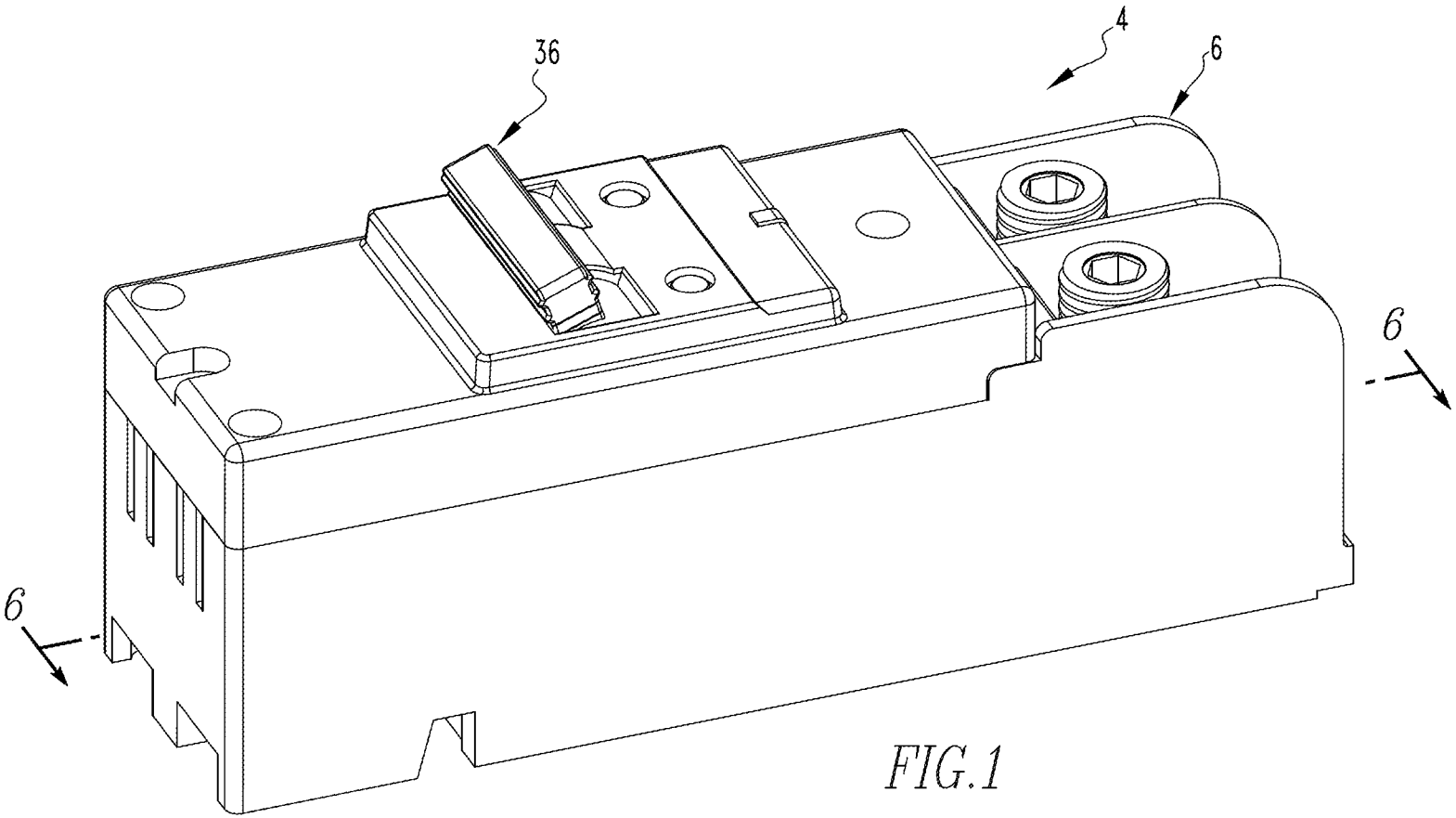
FIG. 1 is a perspective view of an improved circuit interrupter in accordance with the disclosed and claimed concept.
Figure 2:
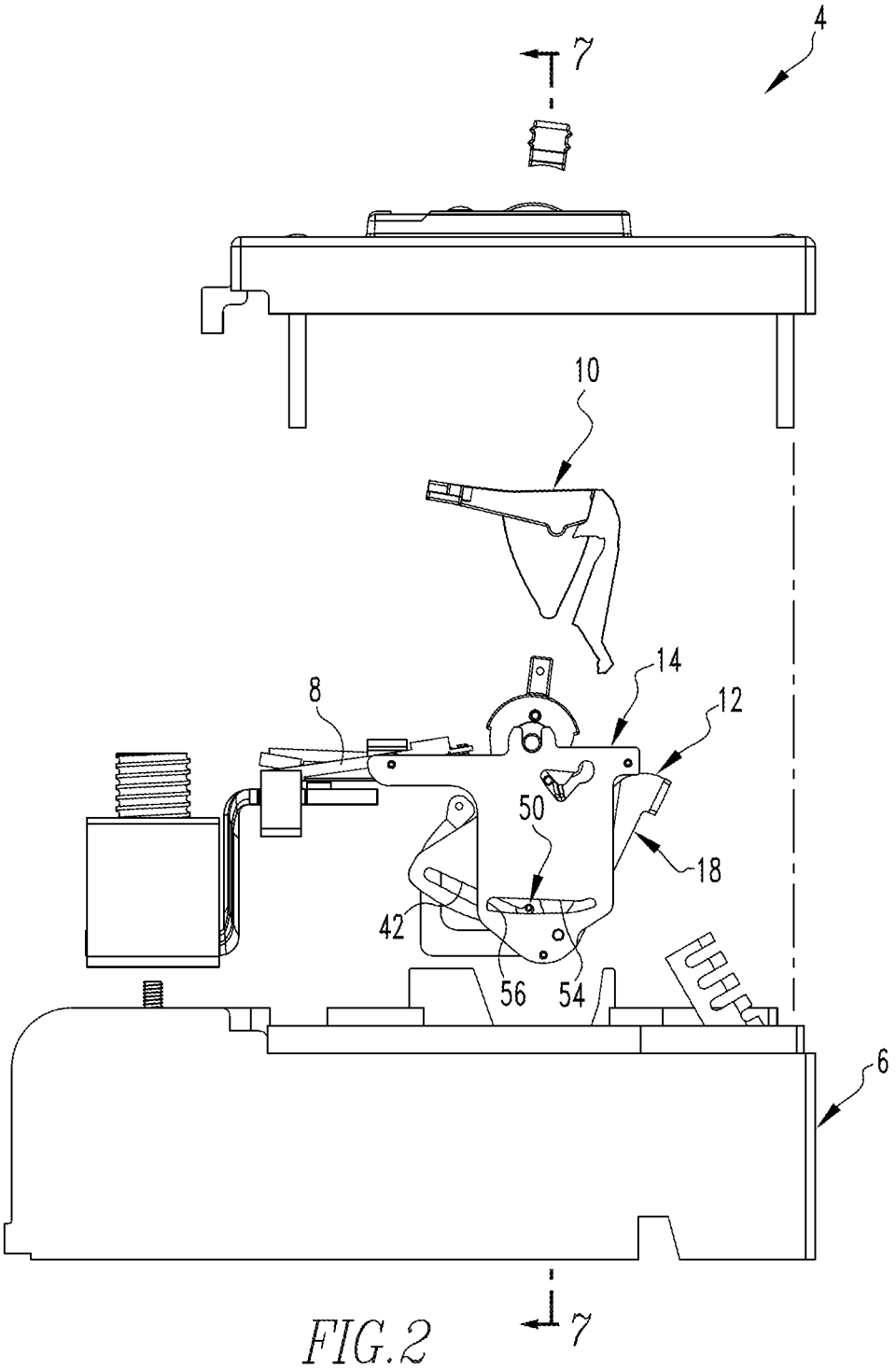
FIG. 2 is an elevational exploded view of the circuit interrupter of FIG. 1.
Figure 20:
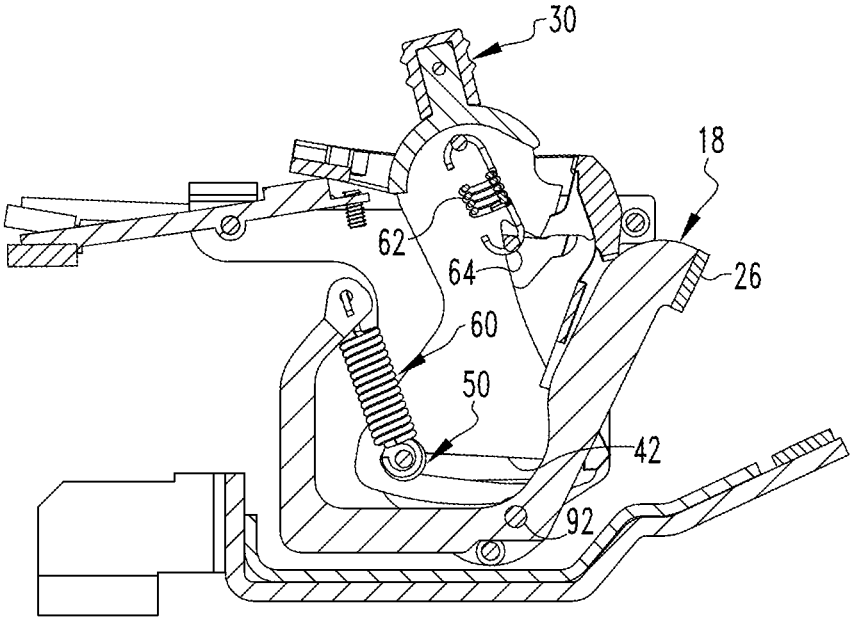
FIG. 20 is a side elevational view of the mechanisms in the TRIPFREE position, except with the handle being retained in the ON position.

An improved circuit interrupter 4 in accordance with the disclosed and claimed concept is depicted generally in FIG. 1 in an OFF position and is depicted in an exploded fashion in FIG. 2. The circuit interrupter 4 is movable among the aforementioned OFF position as well as an ON position, such as is depicted generally in FIGS. 5 and 10, a TRIP position such as is depicted generally in FIG. 14, and a TRIPFREE position such as is depicted generally in FIG. 20. As will be set forth in greater detail below, the circuit interrupter 4 advantageously employs springs that provide a toggle effect in moving among the aforementioned positions of the circuit interrupter 4, which advantageously reduces the effort required to move the circuit interrupter 4 among the various positions and provides other advantages.

As can be understood from FIGS. 1 and 2, the circuit interrupter 4 includes a housing 6 upon which are situated a trip apparatus 8, latch apparatus 10, a pair of mechanisms 12, and a frame 14. In the depicted exemplary embodiment, the trip apparatus 8 includes a thermal trip or a magnetic trip or both, either or both of which can actuate the latch apparatus 10 to trip the circuit interrupter 4 away from the ON position in the event of over-current condition or other condition.

Figure 4:
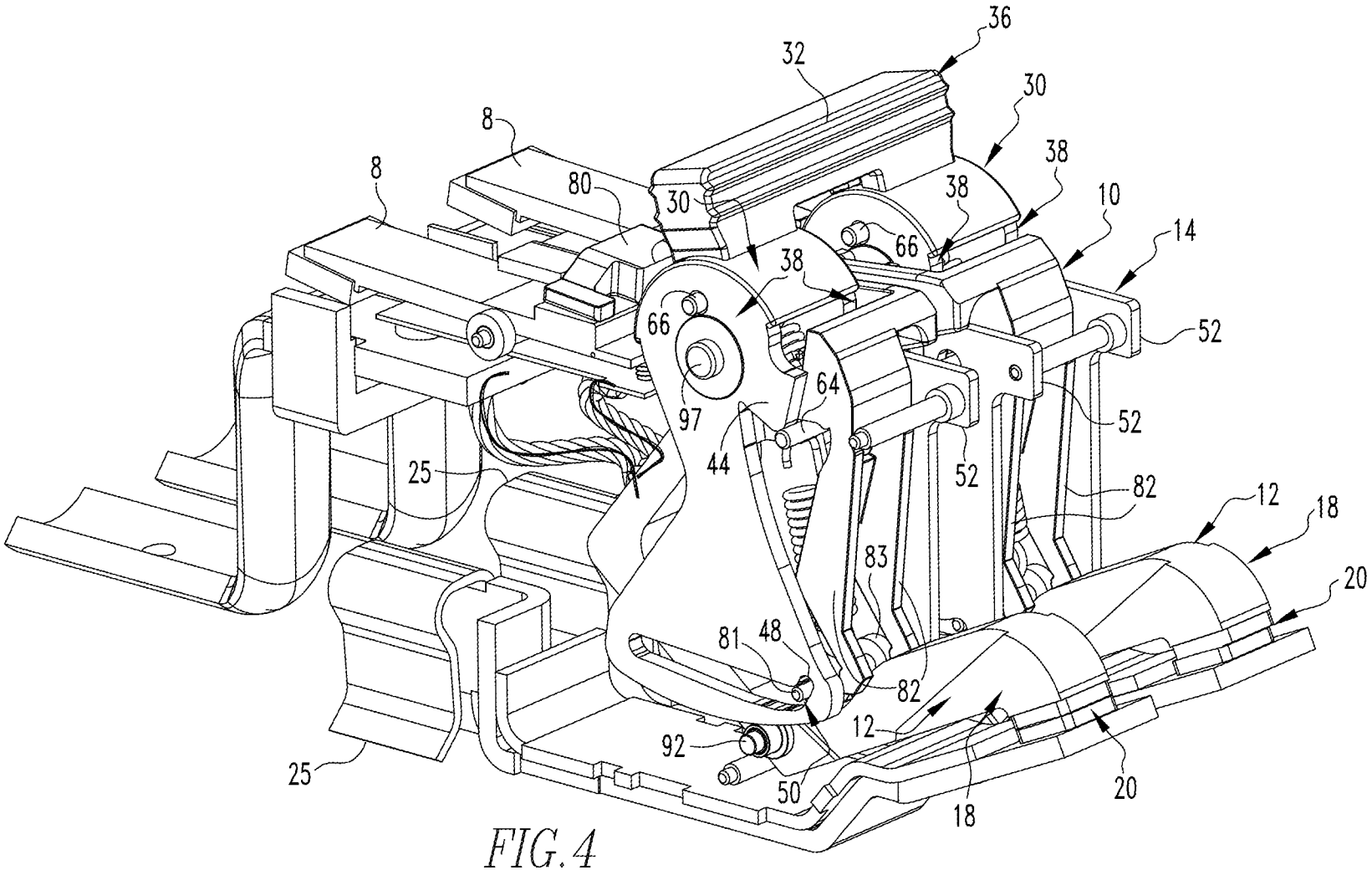
FIG. 4 is a perspective view of the pair of mechanisms and frame of FIG. 3 in the ON position, with a portion of the frame removed to better depict one of the mechanisms.

Each mechanism 12 includes a movable contact arm 18 and a set of separable contact 20. The set of separable contacts 20 include a stationary contact 24 that is affixed to an incoming line terminal 25 which is secured to the housing 6 and a movable contact 26 that is affixed at an end of the contact arm 18 and is thus movable with respect to the stationary contact 24. Each mechanism 12 further includes a handle 30, a portion of which protrudes from the housing 6. The circuit interrupter 4 can further be said to include a connector 32 that extends between the portions of the handles 30 that protrude from the housing 6 such that the pair of handles 30 and the connector 32 together form a handle apparatus 36 that can be manually grasped by technician or other person to move the circuit interrupter 4 among its various positions. As can be understood from FIGS. 2, 4, and 5, by way of example, each handle 30 can be said to include a pair of handle members 32 (four of which are depicted in FIG. 4, the only one of which is depicted in each of FIGS. 2 and 5, by way of example) that are each in the form of a flat plate which, in the depicted exemplary embodiment, is formed of a plastic material. Each handle member 38 further includes a lug 44 that is depicted generally in FIGS. 4 and 5 and that protrudes from other portions of the member 38.

Each handle member 38 has formed therein an elongated handle slot 42 that includes a notch 48 at one end thereof. The notch 48 is a discontinuity in the curvature of the rest of the handle slot 42. Each mechanism 12 further includes a first pin 50 that can be considered in some circumstances to be a part of the handle 30 and that extends between the pair of handle members 38 of the mechanism 12. As will be set forth in greater detail elsewhere herein, the first pin 50 of a given mechanism 12 is generally received and situated in the pair of notches 48 of the given mechanism 12 in the ON, OFF, and TRIP positions of the circuit interrupter 4 but is situated outside the notch 48 and is disposed elsewhere in the pair of handle slots 42 of the given mechanism 12 in the TRIPFREE position.

Figure 3:
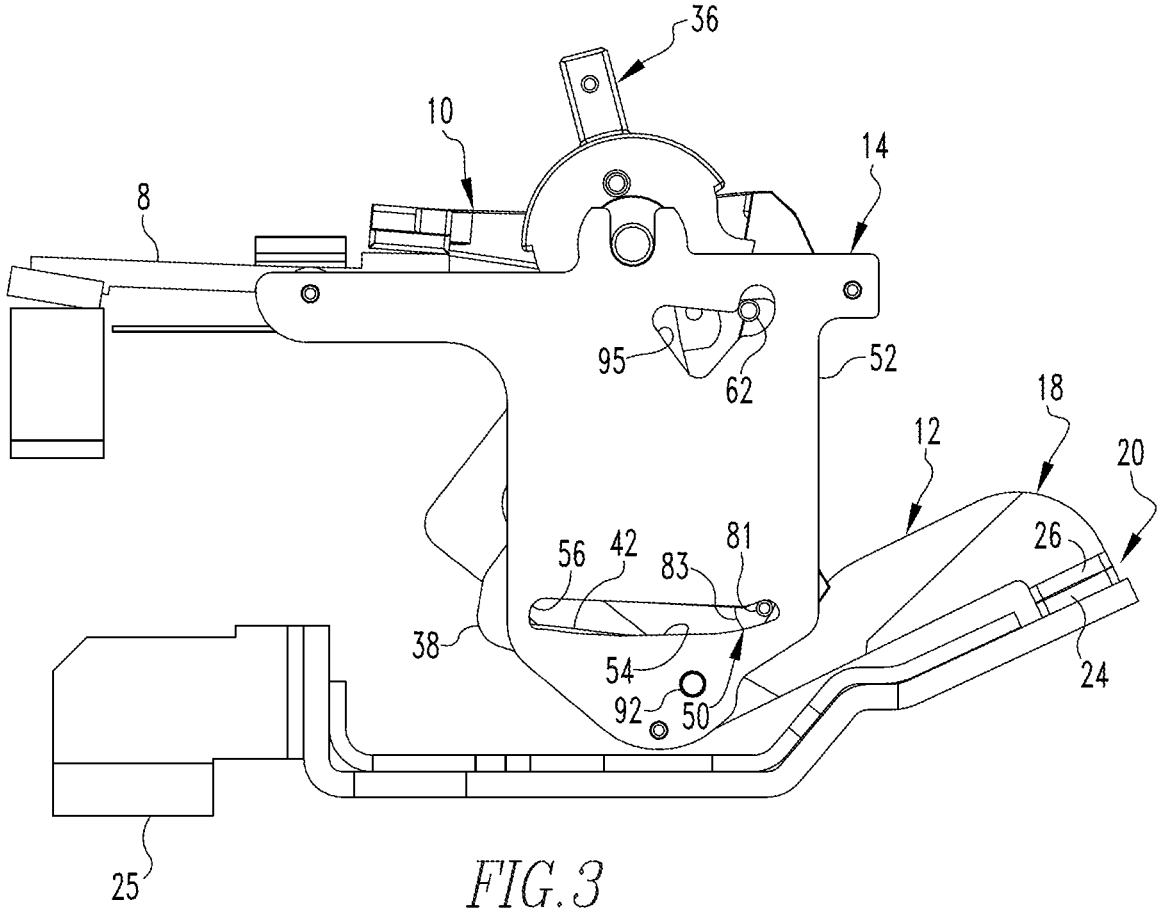
FIG. 3 is a side elevational view of a pair of mechanisms and a frame of the circuit interrupter of FIG. 1 in an ON position.

As can be understood from FIGS. 2-4, for example, the frame 14 includes, for each mechanism 12, a pair of supports 52 upon which the mechanism 12 is situated, it being noted that FIG. 4 depicts only three of the aforementioned supports 52 inasmuch as one of the supports 52 is not depicted in FIG. 4 in order to better depict other components of the circuit interrupter 4, and it is further noted that FIGS. 2 and 3 depict a fourth of the aforementioned supports 52, for a total of four supports 52 for the two mechanisms 12. It is understood that in other embodiments of the circuit interrupter 4 that might include more than two of the mechanisms 12, the frame 14 would be revised to include a pair of the supports 52 for each such mechanism 12. As can be understood from FIGS. 2 and 3 support 52 has formed therein and elongated frame slot 54 having an end 56. The first pin 50 of any given mechanism 12 is also received in the frame slots 54 of the pair of supports 52 upon which the given mechanism 12 is situated. As will be set forth in greater detail elsewhere herein, the first pin 50 engages the ends 56 of the frame slots 54 in the OFF position of FIG. 10 and at least at one point, as at FIGS. 21 and 22, during the resetting the circuit interrupter 4 from the TRIPFREE position toward the OFF position.

Each mechanism 12 further includes (as can be understood from FIG. 8 and from other figures herein) a first spring 60, a second spring 62, and a second pin 64. As will be set forth in greater detail elsewhere herein, an end of the first spring 60 of a given mechanism 12 is connected with the first pin 50 of the given mechanism 12 and is thereby connected with the handle 30 of the given mechanism 12 in at least some of the positions of the given mechanism 12. The second spring of the given mechanism 12 extends between the second pin 64 of the given mechanism 12 and a hub 66 of the given mechanism 12 that extends between the handle members 38 of the given mechanism 12.

Figure 6:
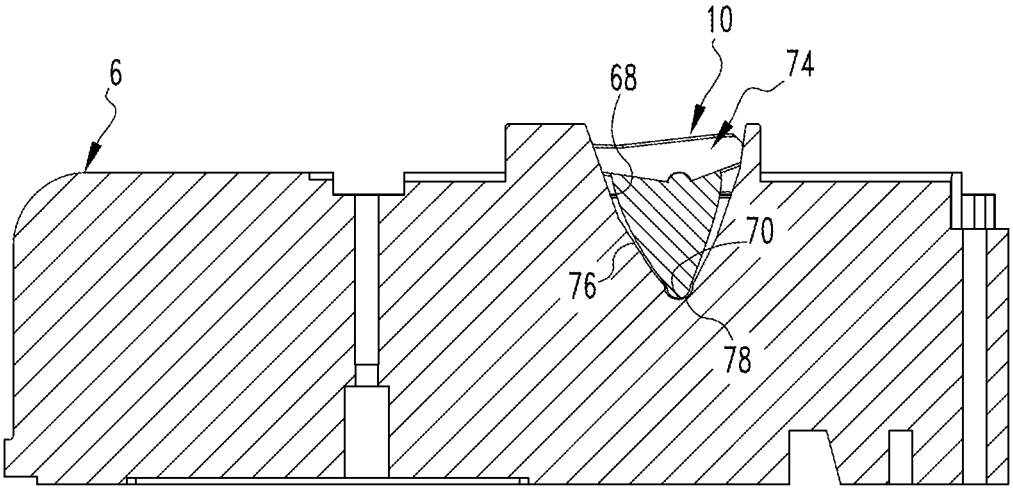
FIG. 6 is a sectional view as taken along line 6-6 of FIG. 1.
Figure 7:
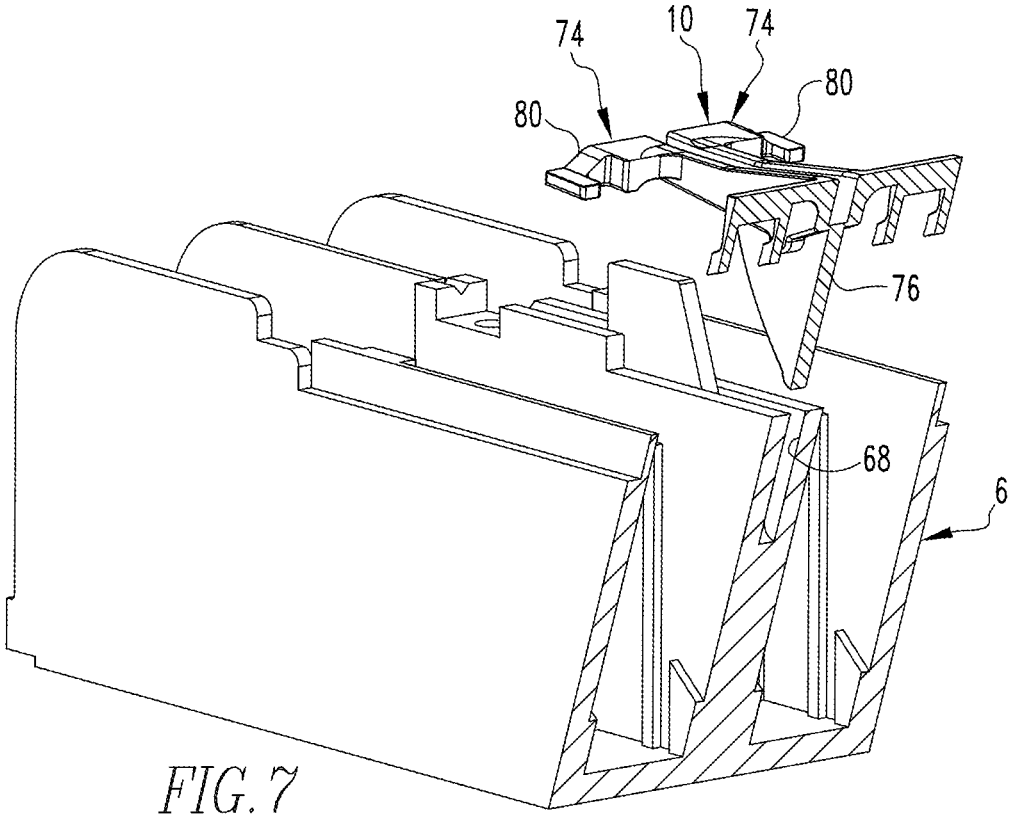
FIG. 7 is a sectional view as taken along line 7-7 of FIG. 2.

As can be understood from FIGS. 2, 6, and 7, the housing 6 has formed therein a receptacle 68 that is situated thereon at a location disposed generally between the pair of mechanisms 12 and, as is best shown in FIG. 6, the receptacle 68 can be said to include a seat 70 that is formed on the housing 6 and that is of a rounded or otherwise arcuate shape. Moreover, the latch apparatus 10 can be said to include a pair of struts 74, i.e., one strut 74 for each corresponding mechanism 12 of the pair of mechanisms 12, and to further include a base 76 with which the struts 74 are connected and that is interposed between the struts 74. The base 76 includes a protrusion 78 that has a rounded or otherwise arcuate shape that is received in the receptacle 68 and that is movably engaged with the seat 70. Each strut 74 may itself be referred to herein as a "latch", and the latch apparatus 10 may itself likewise be referred to herein as a "latch". In a similar fashion, the handle apparatus 36 and the handle 30 may each be referred to herein as a "handle".

Each strut 74 can be said to include an input leg 80 that is elongated and is cooperable with the trip apparatus 8, and to further include a reaction leg 82 that is elongate and that has a surface 87 which, in the TRIPFREE and TRIP situations, is cooperable with the first pin 50. More specifically, the first pin 50 of a given mechanism 12 has a narrower portion 81 (see FIG. 3) that is received in the handle slots 42 and in the frame slots 54 and further includes a wider portion 83 (see FIGS. 3 and 8) that is disposed between the handle members 38 of the given mechanism 12, and it thus can be understood that the narrower portion 81 protrudes from both ends of the wider portion 83. Each strut 74 further includes a tab 84 on which is formed a surface 86 that is engageable with the second pin 64 in certain circumstances, as will be set forth in greater detail elsewhere herein.

Figure 5:
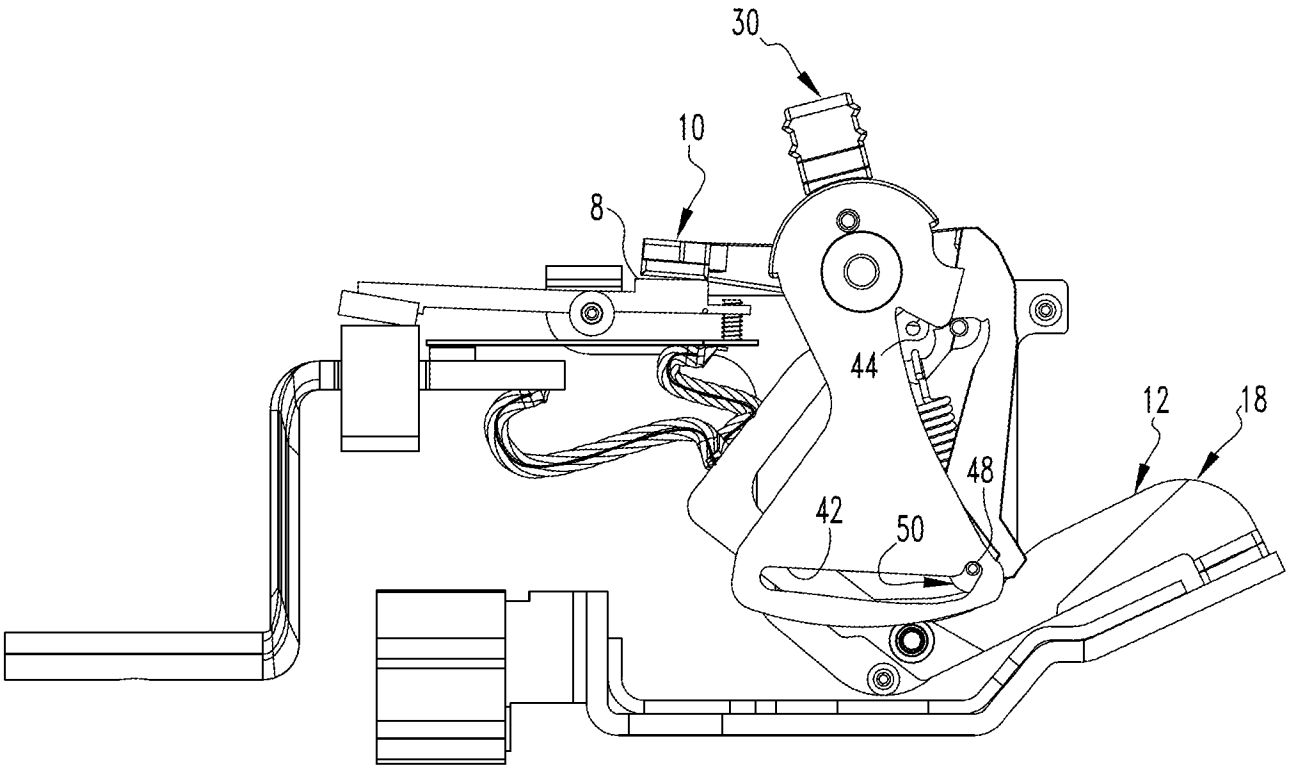
FIG. 5 is a side elevational view of the subject matter of FIG. 4.
Figure 8:
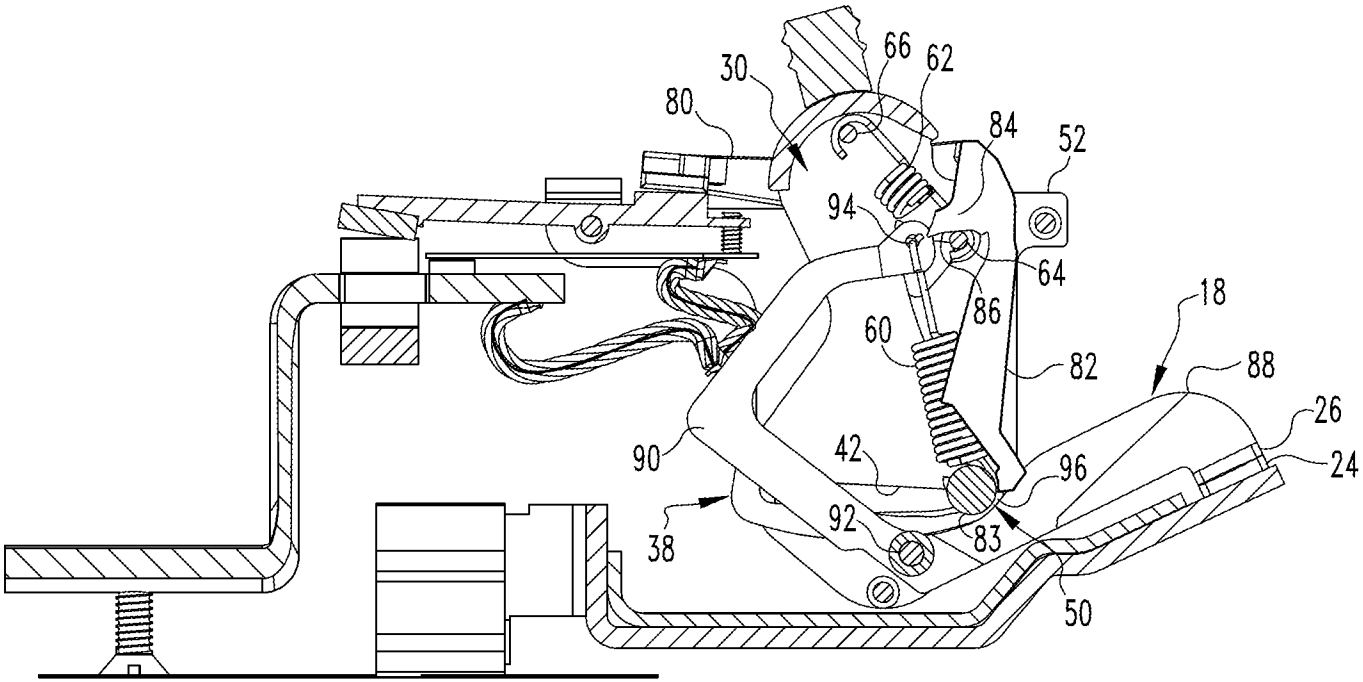
FIG. 8 is a view similar to FIG. 5, except depicting the same subject matter except with a portion of a handle and a portion of a pin removed to better depict a pair of springs, a different pin, and a latch.
Figure 10:
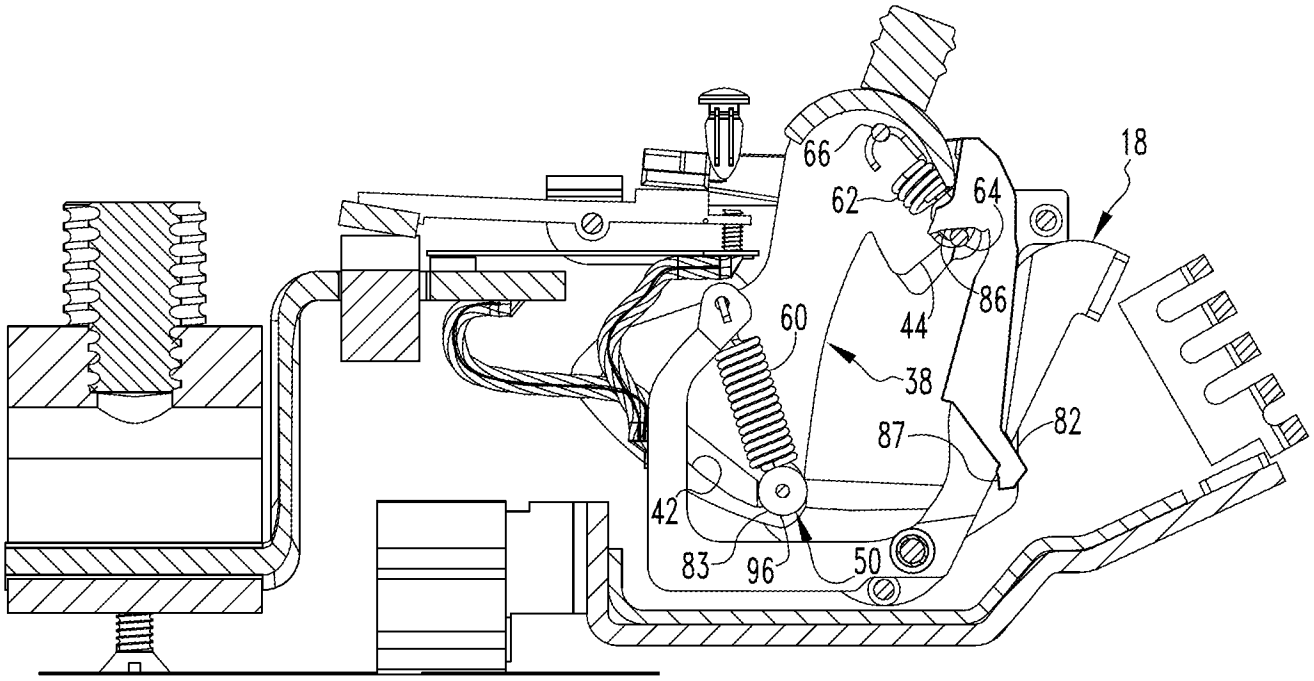
FIG. 10 is a side elevational view of the mechanisms in the OFF position.
Figure 14:
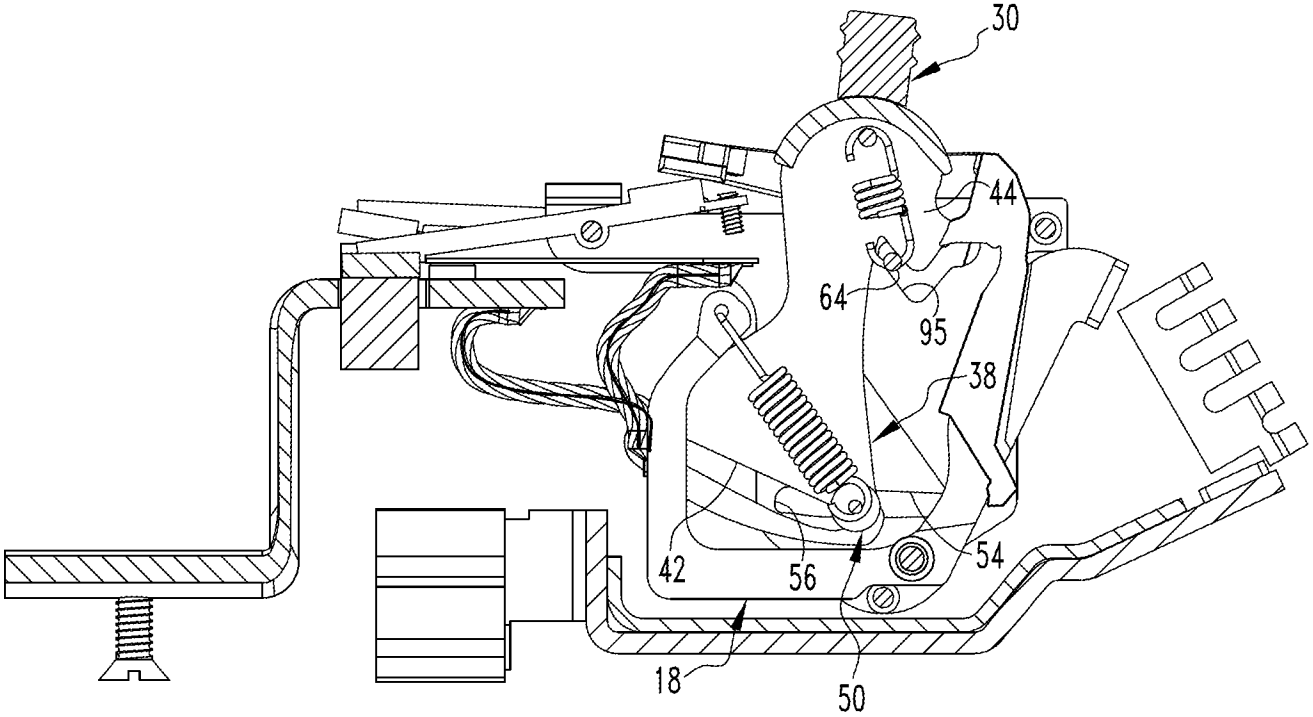
FIG. 14 is a side elevational view of the mechanisms in the TRIP position.

As can be understood from FIGS. 8 and 10, by way of example, the contact arm 18 includes a first portion 88 that is elongated and upon which the movable contact 26 is situated, and the contact arm 18 further includes an elongated second portion 90. The contact arm 18 includes a pivot 92 that is pivotably situated on the frame 14, and the first and second portions 88 and 90 both extend away from the pivot 92. The second portion 90 includes a connection point 94 that is in the exemplary form of a hole that is formed in the second portion 90 and that is situated distal to the pivot 92. The first spring 60 is connected at an end thereof with the connection point 94 and, as noted elsewhere herein is connected at another end thereof with the first pin 50. In this regard, since the first pin 50 is engaged with the handle member 38 within the handle slot 42, the first spring 60 can be said to be thereby engaged with the handle member 38 and thus the handle 30 at an engagement location 96, which is the location at which the first pin 50 is engaged with the handle member 38. As noted elsewhere herein, the first pin 50 is received in the notch 48 and is thus engaged with the handle 30 in the ON position, the OFF position, and the TRIP position, as is shown in FIGS. 5, 10, and 14, respectively, and the engagement location 96 thus would be at the notch 48 in the ON position, the OFF position, and the TRIP position. In the TRIPFREE position, however, where the first pin 50 is situated at a position along the handle slot 42 other than at the notch 48, such other position where the first pin 50 is situated along the handle slot 42 would be the engagement location 96 in that situation.

Figure 9:
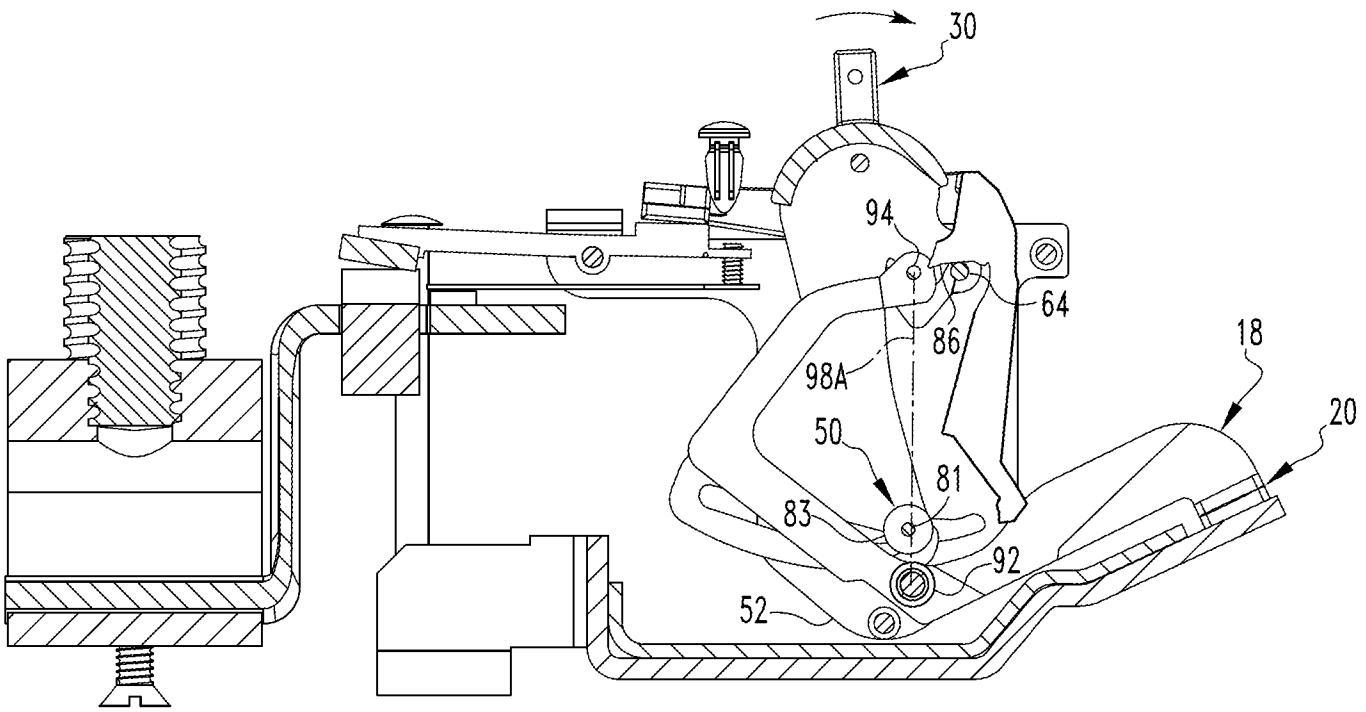
FIG. 9 is a view similar to FIG. 5, except depicting a different portion of the handle removed, and further depicting the mechanisms being moved from the ON position toward an OFF position and is specifically depicted as being situated at a toggle point where certain components of the circuit interrupter are aligned with one another.
Figure 11:
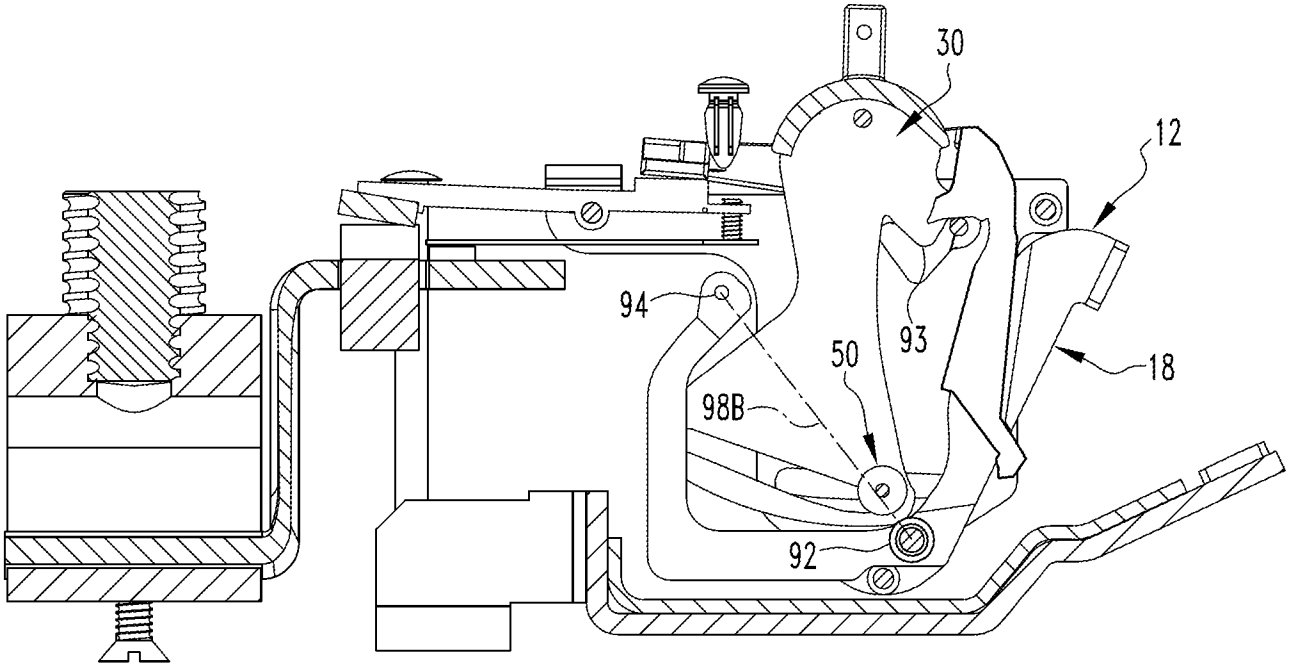
FIG. 11 is a view similar to FIG. 10, except depicting the mechanisms being moved from the OFF position toward the ON position and is specifically depicted as being situated at another toggle point where the same certain components of the circuit interrupter are aligned with one another.

As the circuit interrupter 4 is moved from the ON position of FIG. 8 to the OFF position of FIG. 10, the circuit interrupter 4 moves through a toggle position that is depicted generally in FIG. 9 wherein the first pin 50 and the connection point 94 are aligned with the pivot 92. Indeed, FIG. 9 depicts at the numeral 98A a toggle axis along which these three components are aligned with one another, and the position of the mechanisms 12 in FIG. 9 defines and describes a toggle point of the mechanisms 12 and of the circuit interrupter 4 when moving from the ON position toward the OFF position. As can be seen in FIG. 9, in the toggle position 98A, the set of separable contacts 20 remain engaged with one another despite the fact that the handle 30 has been moved to a location between that of the ON position of FIG. 8 and that the OFF position of FIG. 10. In this regard, it can be understood that as the mechanism 12 is moved from the ON position of FIG. 8 toward the toggle position of FIG. 9, the first spring 60 biases the mechanism 12 toward the ON position until just before the point at which the mechanism reaches the toggle position of FIG. 9. However, when the mechanism 12 is moved slightly beyond the toggle position of FIG. 9 in a direction toward the OFF position of FIG. 10, the first spring 60 biases the mechanism 12 toward the OFF position. As such, it can be understood that the toggling action afforded by the first spring 60 causes the first spring 60 to bias the mechanism 12 toward either the ON position of FIG. 8 or the opposition of FIG. 10 depending upon the location of the first pin 50 being at one side or at the other, respectively, of the toggle axis 98A. This advantageously avoids requiring the user to overcome the bias of a spring such as was required in prior circuit breakers to place the prior circuit breakers in their ON or OFF positions, which advantageously saves effort. It can also be seen that the second pin 62 remains engaged with the tab 84 at the surface 86 throughout the motion between the ON position of FIG. 8 and the OFF position of FIG. 10. When the mechanisms 12 are returned from the OFF position of FIG. 10 to the ON position of FIG. 8, the mechanisms 12 move through another toggle point that is depicted in FIG. 11 and is shown generally at the numeral 98B where the first pin 50 and the connection point 94 are again aligned with the pivot 92 at another toggle axis 98B, although it can be seen that the toggle axis 98B of FIG. 11 is different than the toggle axis 98A of FIG. 9.

Figure 12:
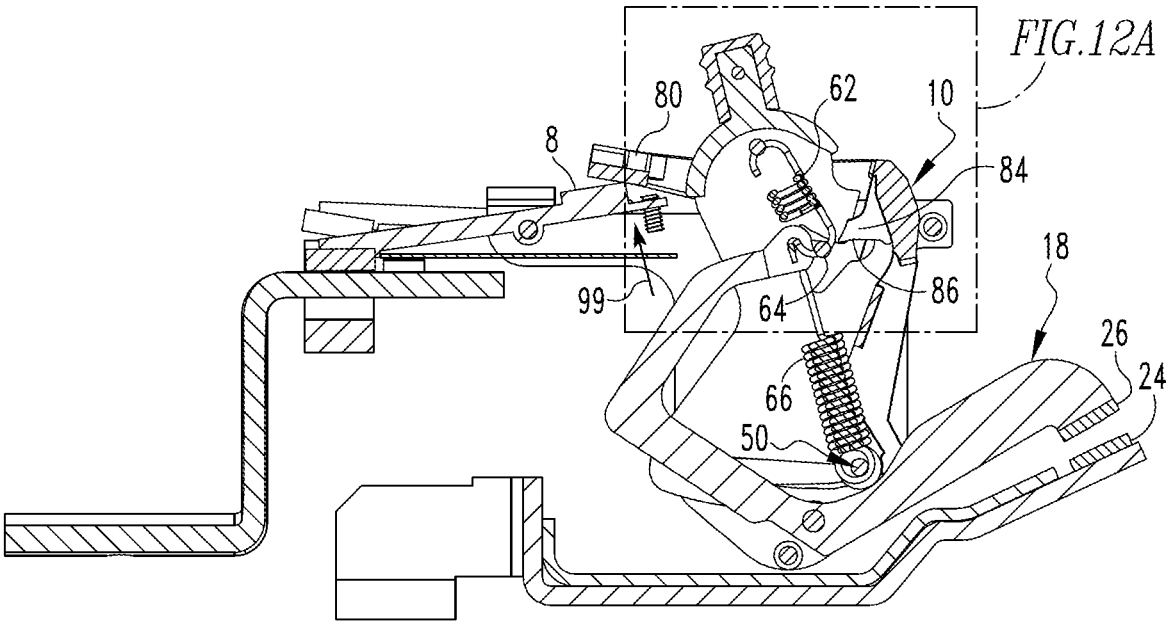
FIG. 12 is a view similar to FIG. 8, except depicting the mechanism being moved from the ON position toward a TRIP position and is specifically depicting the different pin having become disengaged from the latch and being biased into engagement with a movable contact arm of the mechanism and further depicting the pin, which is one of the certain components, being situated at one side of the toggle point.
Figure 12A:
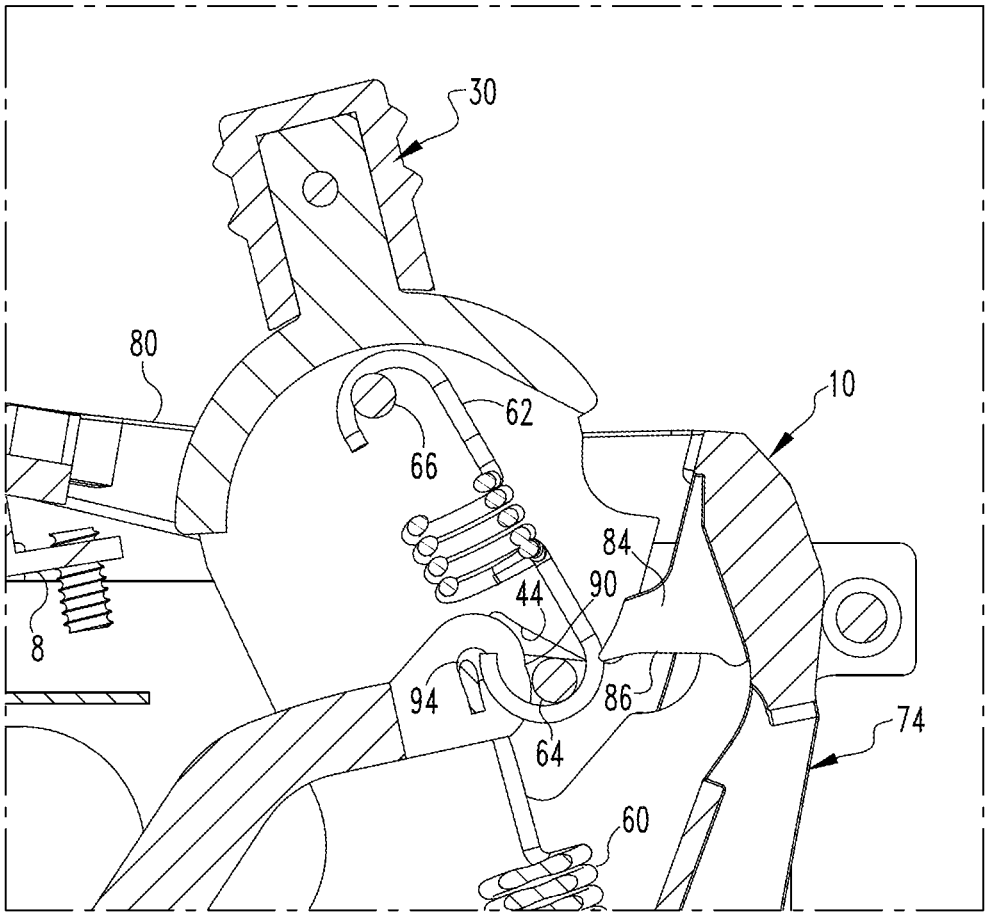
FIG. 12A is an enlargement of an indicated portion of FIG. 12.
Figure 13:
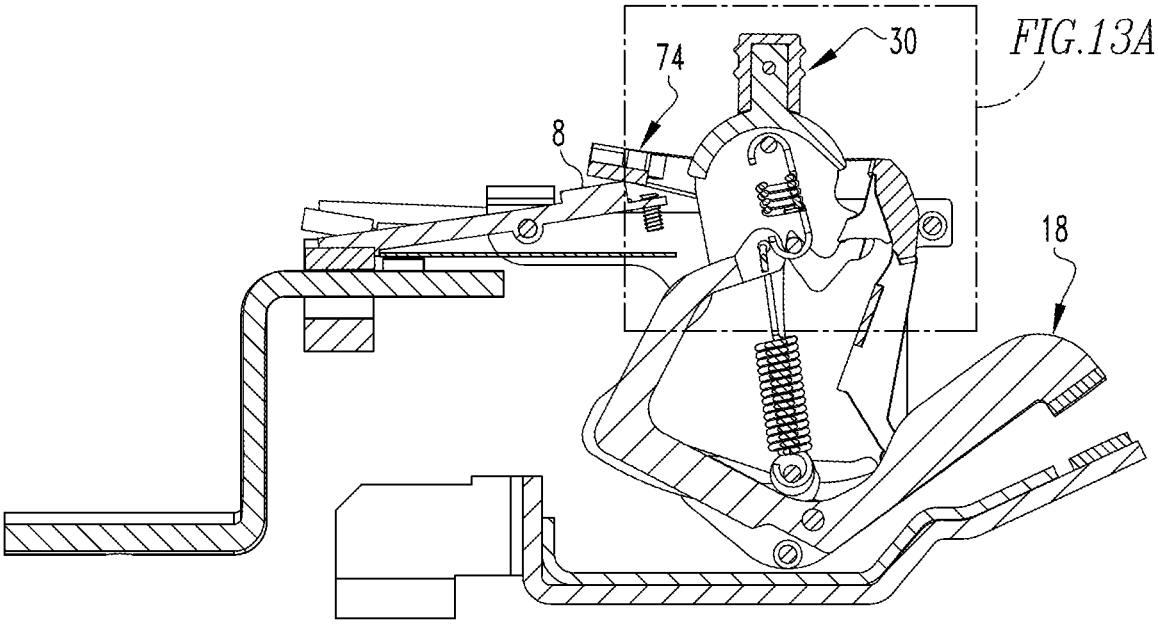
FIG. 13 is a view similar to FIG. 12, except depicting the pin being situated at another side of the toggle point.

In a TRIP situation, as is depicted generally in FIGS. 12-14, the trip apparatus 8 has engaged the input leg 80 of the latch 10, which has caused the latch 10 to pivot or otherwise move on the protrusion 78 with respect to the housing 6 and also with respect to the mechanisms 12 to cause the second pin 64 to be disengaged from the surface 86 of the tab 84. That is, in the ON position of FIG. 8 and the OFF position of FIG. 10, and in positions therebetween, the second spring 62 biases the second pin 64 against the surface 86 of the tab 84. However, in an overcurrent condition or other appropriate condition that causes the trip apparatus 8 to move in the direction of the arrow 99 in FIG. 12 to engage the input leg 80 of the latch 10 and to cause the latch 10 to rotate in the clockwise direction from the perspective of FIG. 12, the orientation of the surface 86 changes with respect to the second pin 64. In such a situation, the bias of the second spring 62 that ordinarily would engage the second pin 64 with the surface 86 instead, as a result of the change in the orientation of the surface 86, biases the second pin 64 in a direction toward a free end of the second portion 90 of the contact arm 18, as is depicted in FIGS. 12 and 12A. Such engagement of the second pin 64 with the second portion 90 of the contact arm 18 and the bias of the second spring 62 thereon rotates the contact arm 18 in the counter-clockwise direction from the perspective of FIG. 12 and separates the movable contact 26 from the stationary contact 24.

Figure 13A:
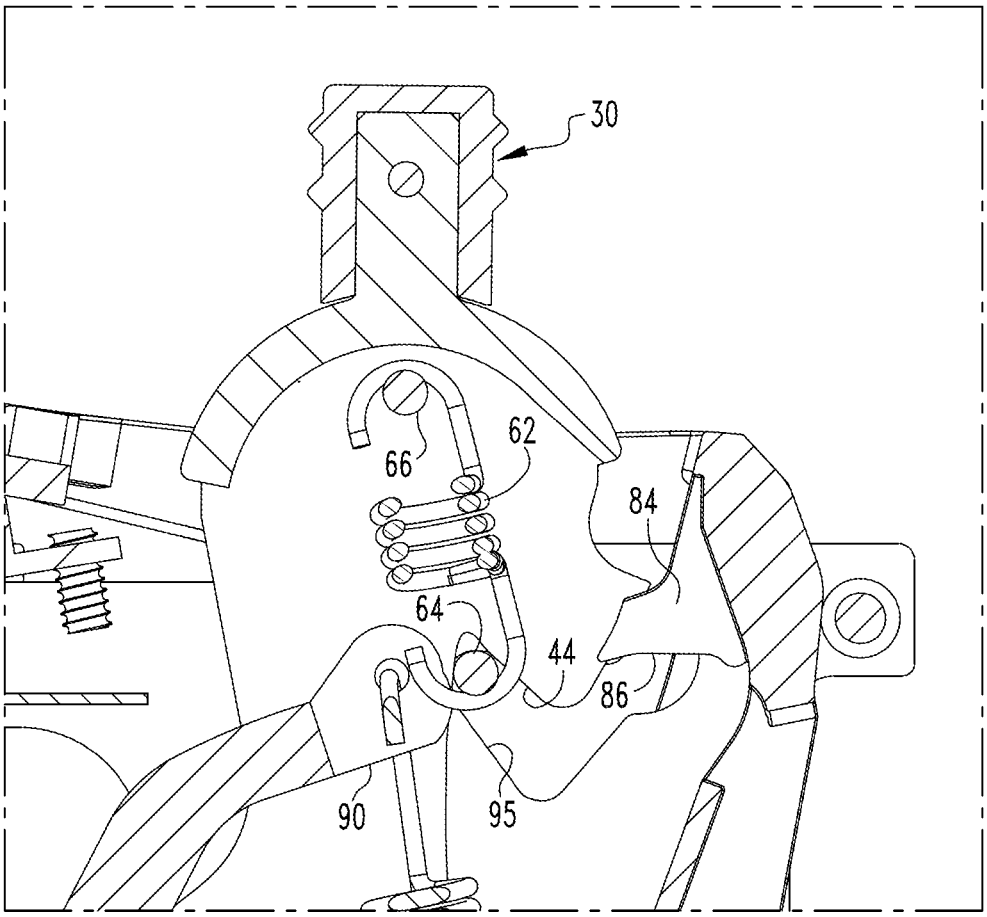
FIG. 13A is an enlargement of an indicated portion of FIG. 13.

Since the first spring 60 is connected between the connection point 94 and the first pin 50, and since the first pin 50 is received in the notch 48 and is thereby engaged with the handle 30, the surface 87 of reaction leg 82 of the latch 10 pushes the first pin 50 in leftward direction from the perspective of FIG. 12 along with notch 48 of the handle 30 in the leftward direction from the perspective of FIG. 12. Such movement of the contact arm 18 in the counter-clockwise direction moves the first spring 60 in a leftward direction from the perspective of FIG. 12 and thus causes the handle 30, to which the first spring 60 is connected via engagement of the first pin 50 in the notch 48, to resultantly pivot in the clockwise direction from the perspective of FIG. 12 about an axle 97 of the handle 30. Once the contact arm 18 and the handle 30 have moved with respect to one another sufficiently, as is depicted generally in FIGS. 13 and 13A, that the first pin 50 has moved beyond a toggle point at which the connection point 94 and the first pin 50 are aligned with the pivot 92, the first spring 60 biases the contact arm 18 toward the TRIP position that is depicted generally in FIG. 14. In so doing, the free end of the second portion 90 of the contact arm 18 is completely disengaged from the second pin 62, and the second pin 62 rather is biased by the second spring 62 in engagement with the lug 44 of the handle 30 and interposed between the lug 44 and a positioning surface 95 that is formed on the frame 14. It can further be seen from FIG. 14 that, in the TRIP position, the first pin 50 remains in the notch 48 biased by the first spring 60 into engagement with the handle 30.

Figure 15:
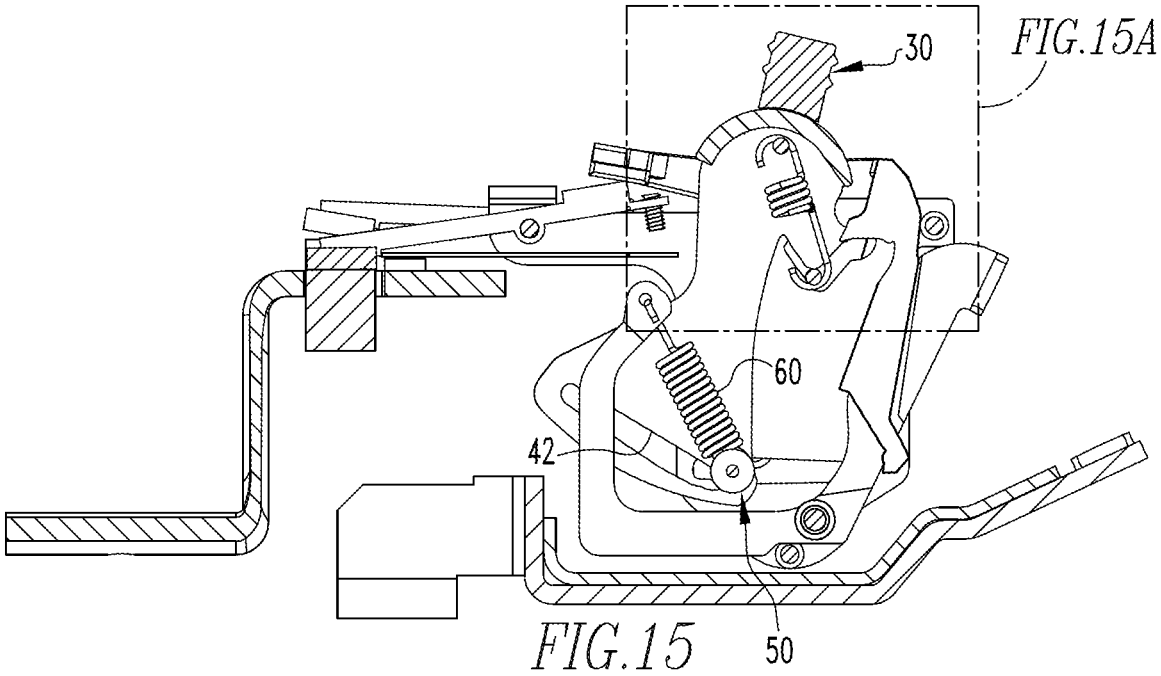
FIG. 15 is a side elevational view of the mechanisms being moved from the TRIP position toward the OFF position, and specifically depicting the different pin being moved with respect to the handle.
Figure 15A:
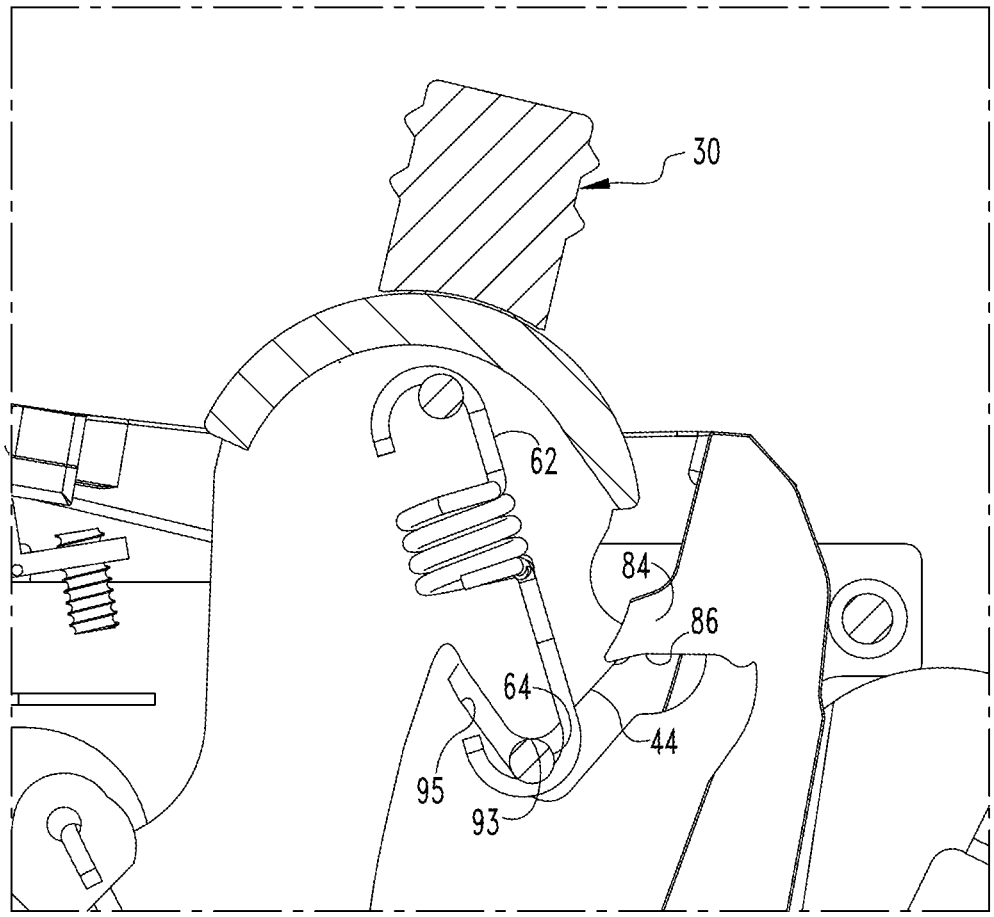
FIG. 15A is an enlargement of an indicated portion of FIG. 15.
Figure 16:
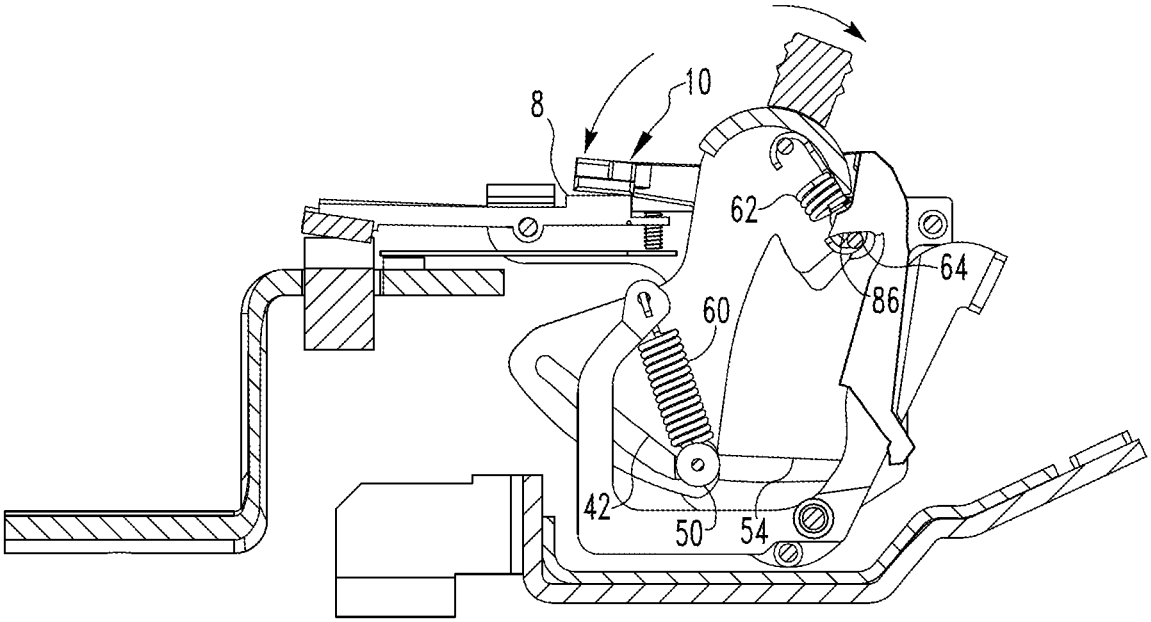
FIG. 16 is another side elevational view of the mechanisms being moved from the TRIP position farther toward the OFF position, and specifically depicting the different pin being disengaged from the handle and being biased into engagement with the latch.

In order to reset the circuit interrupter 4 from the TRIP position of FIG. 14 to the OFF position of FIG. 10, the handle 30 is rotated, as in FIGS. 15 and 15A, in the clockwise direction from the perspective FIGS. 15 and 15A toward the OFF position to cause the second pin 64 to be forced in the space between the lug 44 and positioning surface 95 to pass around an apex 93 (FIG. 15A) of the lug 44, after which the bias of the second spring 62 causes the second pin 64 to engage, as in FIG. 16, the surface 86 of the tab 84. The bias of the second spring 62 that biases the second pin 64 against the tab 84 of the latch 10 causes the latch 10 to rotate, as in FIG. 16, in the counter-clockwise direction from the perspective of FIG. 16 and to result in the circuit interrupter 4 moving to the OFF position that is depicted generally in FIG. 10.

Figure 17:
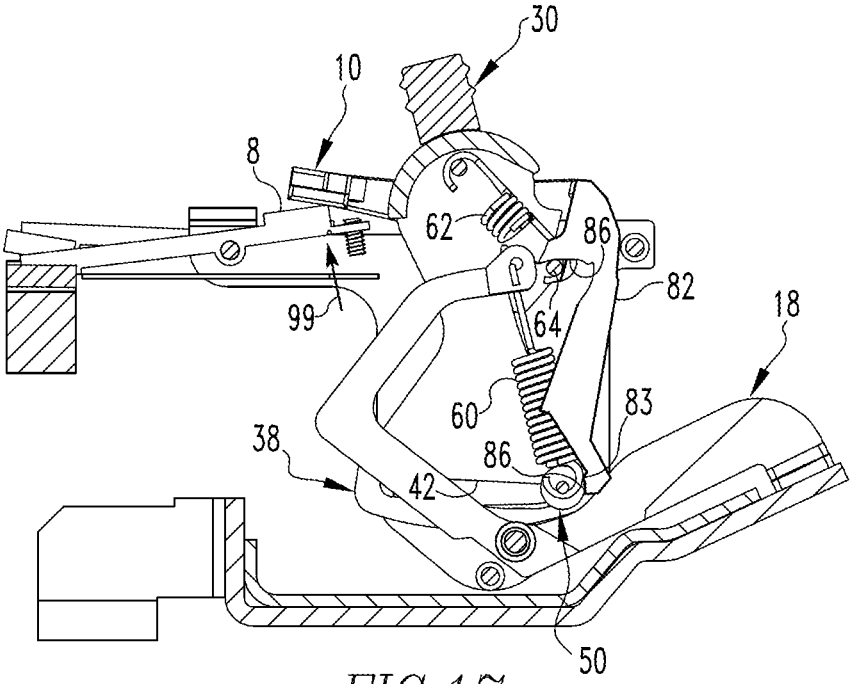
FIG. 17 is a view similar to FIG. 12, except depicting the mechanism being moved from the ON position toward a TRIPFREE position in a situation wherein the handle is being retained in the ON position in a trip situation of the circuit interrupter, and wherein a portion of the latch is depicted as being engaged with the pin.
Figure 18:
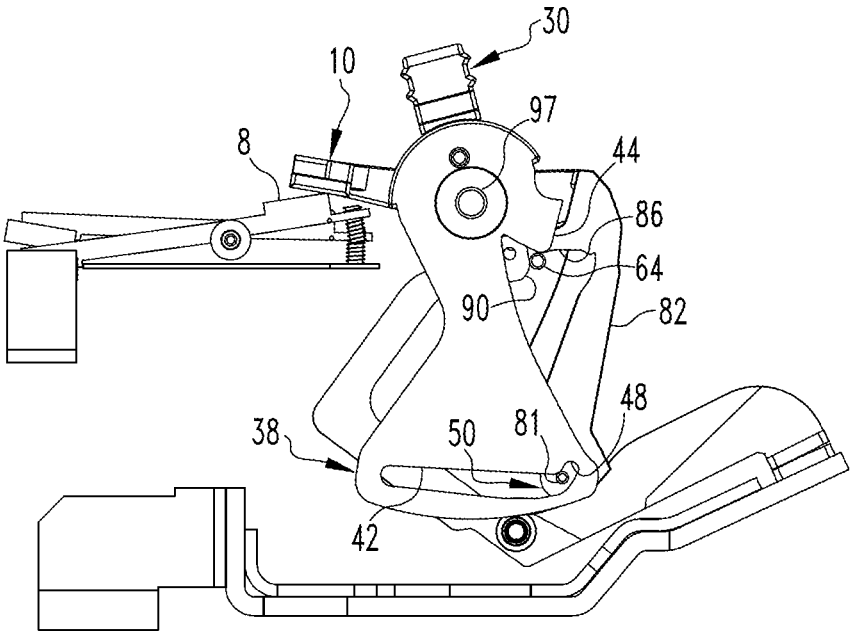
FIG. 18 is a view similar to FIG. 17, except additionally depicting a portion of the handle that is not shown in FIG. 17, the portion of the handle depicted in FIG. 18 having a slot formed therein, with the slot having a notch at an end thereof, and with the engagement of the latch with the pin that is depicted in FIG. 17 causing the pin to become disengaged from the notch as depicted in FIG. 18.

It is also possible, however, that the handle 30 may be retained in the ON position of the circuit interrupter 4, such as with the use of a locking device or other securement, in such a fashion to retain the handle 30 in its ON position while trip apparatus 8 has moved in the direction of the arrow 99 in FIG. 17 to engage the latch 10, such as might result in a trip situation on the circuit interrupter 4. Since the locking device or securement has retained the handle 30 in the position that is depicted generally in FIG. 17, the rotation of the latch 10 in the clockwise direction from the perspective of FIG. 17 that results from the trip apparatus 8 moving in the direction of the arrow 99 and engaging the input leg 80 causes the orientation of the surface 86 to change with respect to the second pin 64. In such a situation, the bias of the second spring 62 that ordinarily would engage the second pin 64 with the surface 86 instead, as a result of the change in the orientation of the surface 86, biases the second pin 64 in a direction toward a free end of the second portion 90 of the contact arm 18, as is depicted in FIG. 18 and at the same time the surface 87 of the reaction leg 82 engages the first pin 50 and push the first pin 50 out of the notch 48, such as is depicted generally in FIGS. 17 and 18. That is, FIG. 18 depicts the handle member 38 and its handle slot 42 and further depicts the first pin 50 being disengaged from the notch 48, whereas FIG. 17 depicts the same position of the mechanism 12 but does not depict the handle member 38 in order to better depict the engagement of the reaction leg 82 with the wider portion 83 of the first pin 50.

Figure 19:
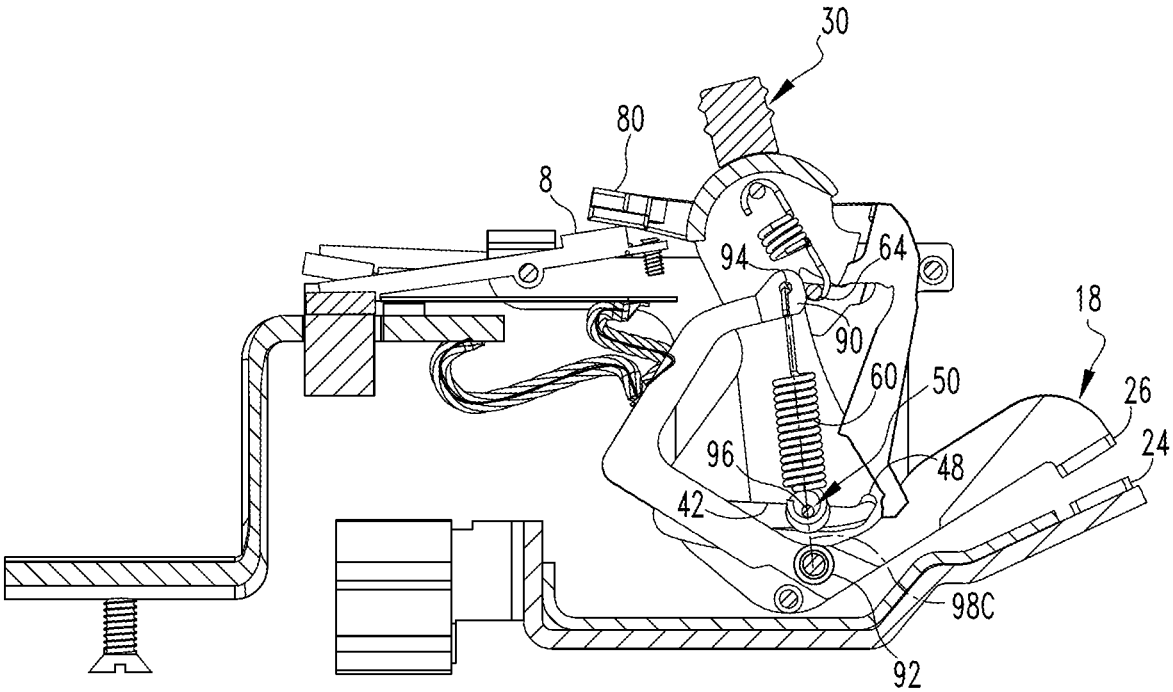
FIG. 19 is a view similar to FIG. 18, except additionally depicting the pin fully disengaged from the notch and having moved under the bias of a spring of the pair of springs to another position along the slot spaced from the notch wherein the same certain components of the circuit interrupter are aligned with one another at yet another toggle point of the mechanism.

Once the first pin 50 is disengaged from the notch 48, as is depicted in FIG. 18, the first pin 50 is free to move along the handle slot 42 and frame slot 54 as a result of the bias of the first spring 60 on the first pin 50. In so doing, the first pin 50 will move along in either the handle slot 42 or the frame slot 54, or both, and will eventually reach another toggle point that is depicted in FIG. 19 where the connection point 94, the first pin 50, and the pivot 92 are again aligned with one another along yet another toggle axis that is depicted generally at the numeral 98C, it being noted that the mechanism 12 is depicted at such other toggle point in FIG. 19. Once the bias of the first spring 60 has moved the first pin 50 beyond the toggle point that is depicted generally in FIG. 19 and in a direction toward the TRIPFREE TRIP position that is depicted generally in FIG. 20, the mechanism 12 has been caused to move to its TRIPFREE TRIP position despite the handle 30 remaining in what would be its ON position as a result of the aforementioned locking device.

Figure 21:
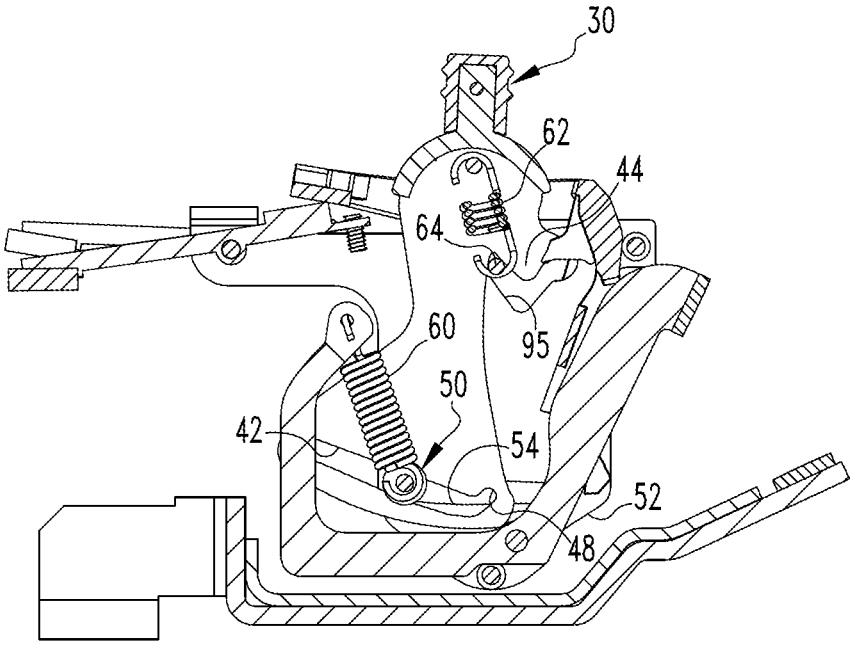
FIG. 21 is view similar to FIG. 20, except depicting the handle having been released from the ON position.

Once the locking device has been removed from the handle 30, the handle 30 under the bias of the first and second springs 60 and 62 relaxes to a TRIPFREE HANDLE RELEASE position that is depicted generally in FIG. 21 where the first pin 50 is engaged with the end 56 of the frame slot 54. It thus can be understood that the circuit interrupter 4 can be tripped to advantageously cause the set of separable contacts 22 become separated even though the handle 30 has been retained in its ON position.

Figure 22:
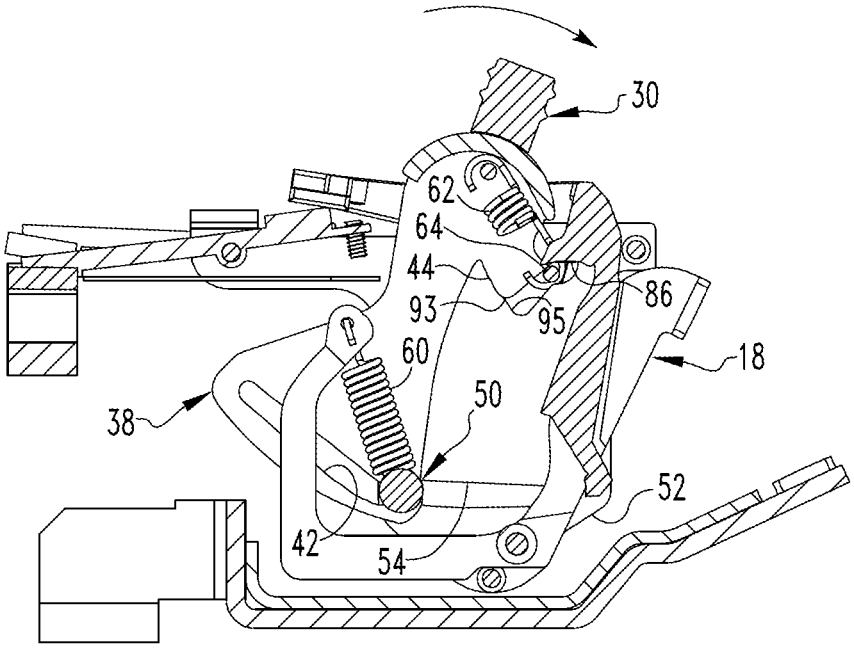
FIG. 22 is view depicting the mechanisms being reset from the TRIPFREE position toward the OFF position wherein the handle has been pivoted to cause the pin to again be received in the notch and to cause the different pin to become disengaged from the handle and has begun to engage the latch.
Figure 23:
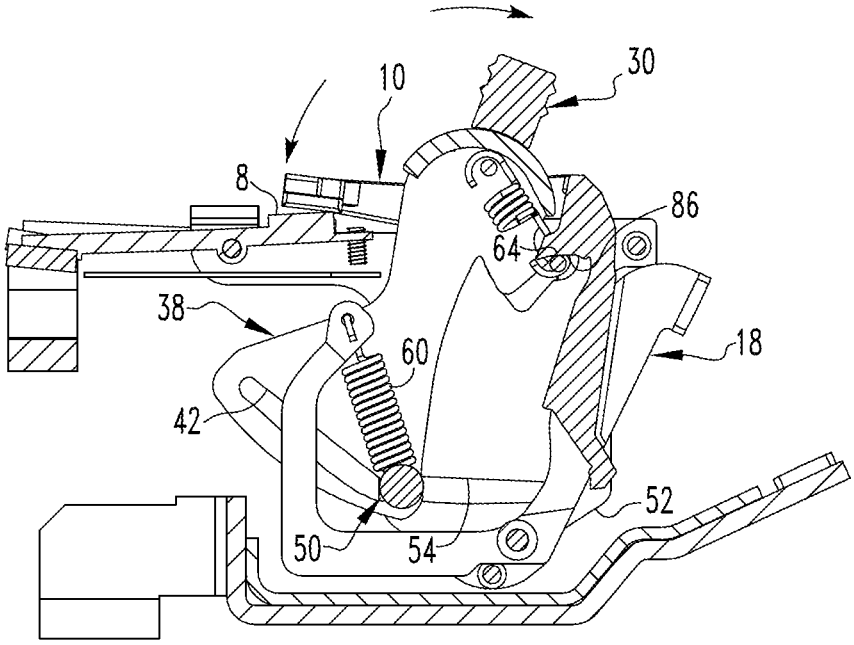
FIG. 23 is view depicting the mechanisms being reset from the TRIPFREE position further toward the OFF position wherein the handle has been further pivoted to cause the different pin to bias the latch toward the OFF position.

In order to reset the circuit interrupter 4 from the TRIPFREE HANDLE RELEASE position that is depicted generally in FIG. 21, the handle 30 is pivoted, as is depicted generally in FIG. 22, toward the OFF position. Such rotation of the handle 30, which is in the clockwise direction from the perspective of FIG. 22, causes the first pin 50, which is engaged with the end 56 of the frame slot 54 and is thus held stationary with respect to the frame 14, to remain in such position until the handle 30 can be pivoted sufficiently to cause the first pin 50 to be received back in the notch 48 under the bias of the first spring 60, such as is depicted generally in FIG. 22. Such rotation of the handle 30 also forces the second pin 62 to move from the position interposed between the lug 44 and positioning surface 95, such as is depicted generally in FIG. 21, to a location engaging the surface 86 of the tab 84 of the latch 10, such as is depicted generally in FIG. 22. The bias of the second pin 64 against the tab 84 as a result of the bias of the second spring 62 causes the latch 10, as in FIG. 23, to rotate in the counter-clockwise direction from the perspective of FIG. 23, and further rotation of the latch is such direction causes the mechanism 12 and the circuit interrupter 4 to return to the OFF position of FIG. 10.

It thus can be seen that the improved circuit interrupter 4 can interrupt current to a protected portion of a circuit and is movable between an ON position, an OFF position, a TRIP position, and a TRIPFREE position. The circuit interrupter 4 and the mechanisms 12 employ the bias of the first and second springs 60 and 62 and a plurality of toggle positions of the mechanisms 12 to move the mechanisms 12 among their various positions. Such toggling is done in a fashion that employs the bias of the first and second springs 60 and 62 to move the circuit interrupter 4 to its various positions rather than having to overcome the bias of various springs to do such movement. This is highly advantageous, requires relatively reduced effort, and results in greater reliability of the circuit interrupter 4. Other benefits will be apparent.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A circuit interrupter movable among an ON position, an OFF position, and a TRIP position, comprising:

a housing;

a latch situated on the housing;

a number of mechanisms situated on the housing, each mechanism of the number of mechanisms comprising:

a contact arm that is movable with respect to the housing;

a set of separable contacts comprising a stationary contact and further comprising a movable contact situated on the contact arm;

a handle;

a pin;

a first spring that extends between the contact arm and the handle in at least one of the OFF position and the ON position;

a second spring that extends between the handle and the pin; and the pin being movable among a position engaged with the latch in at least one of the ON position and the OFF position and another position engaged with the handle in the TRIP position, wherein, for each mechanism of the number of mechanisms:

the contact arm comprises a first portion on which the movable contact is situated, a second portion having a connection point, and a pivot that is disposed on the housing and is situated between the first portion and the second portion;

an end of the first spring being connected with the connection point, another end of the first spring being engaged with the handle at an engagement location on the handle in the at least one of the ON position and the OFF position;

the connection point, the engagement location, and the pivot being aligned with one another at a toggle point of the mechanism between the ON position and the OFF position, the first spring being structured to bias the mechanism toward the ON position when the engagement location is at a side of the toggle point, the first spring being structured to bias the mechanism toward the OFF position when the engagement location is at another side of the toggle point.

2. The circuit interrupter of claim 1 wherein the number of mechanisms comprise a pair of mechanisms, wherein the housing has a seat formed therein between the pair of mechanisms, and wherein the latch has a base, the base being movably received in the seat.

3. The circuit interrupter of claim 1 wherein the second spring biases the pin into engagement with the latch in the OFF position and the ON position, the latch being movable with respect to the housing and being situated in a position with respect to the housing in the OFF position and the ON position, and responsive to a predetermined condition:

the latch moving away from the position; and the second spring biasing the pin out of engagement with the latch and into engagement with the contact arm and moving the contact arm from the ON position to a location at or beyond the another side of the toggle point to cause the first spring to move the circuit interrupter to the TRIP position.

4. The circuit interrupter of claim 3 wherein the handle comprises a lug and, when the handle is moved from the TRIP position to the OFF position:

the lug engages the pin and overcomes the bias of the second spring to move the pin back into engagement with the latch; and the second spring biases the pin engaged with the latch to move the latch back to the OFF position.

5. The circuit interrupter of claim 1 wherein:

the second spring biases the pin into engagement with the latch in the OFF position and the ON position, the latch being movable with respect to the housing and being situated in a position with respect to the housing in the OFF position and the ON position;

the handle comprises another pin with which the first spring is connected, the handle further comprising a member having formed therein a slot that is elongated and that includes a notch, the another pin being situated in the slot and being biased by the first spring against the member at a location on the member that serves as the engagement location, the another pin being biased by the first spring into the notch in the OFF position and the ON position; and responsive to a predetermined condition when the handle is retained in the ON position:

the latch moving away from the position;

the latch engaging the another pin and overcoming the bias of the first spring to move the another pin out of the notch, the bias of the first spring moving the another pin to another location along the slot other than at the notch and thereby moving the engagement location to the another location to form another toggle point of the mechanism that includes the connection point, the pivot, and the another engagement location; and the second spring biasing the pin out of engagement with the latch and into engagement with the contact arm and moving the contact arm from the ON position to a location at or beyond the another toggle point to cause the first spring to move the circuit interrupter to the TRIP position.

6. The circuit interrupter of claim 5 wherein the handle comprises a lug and, when the handle is no longer retained in the ON position and is moved from the TRIP position to the OFF position:

the lug engages the pin and overcomes the bias of the second spring to move the pin back into engagement with the latch; and the second spring biases the pin engaged with the latch to move the latch back to the OFF position; and the another pin moves along the slot to the notch and is biased by the first spring into the notch.

7. The circuit interrupter of claim 6 wherein the number of mechanisms comprise a frame, the frame having formed therein another slot that is elongated and that has an end, the another pin also being received in the another slot, the another pin being engaged with the end during at least a portion of at least one of:

the moving of the another pin along the slot to the notch; and the biasing of the another pin into the notch by the first spring.

8. A circuit interrupter movable among an ON position, an OFF position, and a TRIP position, comprising:

a housing;

a latch situated on the housing;

a number of mechanisms situated on the housing and cooperable with the latch to move the circuit interrupter from the ON position to the TRIP position, each mechanism of the number of mechanisms comprising:

a contact arm that is movable with respect to the housing;

a set of separable contacts comprising a stationary contact and further comprising a movable contact situated on the contact arm;

a spring connected with the contact arm; and a handle comprising a pin with which the spring is further connected, the handle further comprising a member having formed therein a slot that is elongated and that includes a notch, the pin being situated in the slot, the pin being biased by the first spring into the notch in the OFF position and the ON position.

9. The circuit interrupter of claim 8 wherein, for each mechanism of the number of mechanisms:

the contact arm comprises a first portion on which the movable contact is situated, a second portion having a connection point, and a pivot that is disposed on the housing and is situated between the first portion and the second portion;

an end of the spring being connected with the contact arm at the connection point, another end of the spring being connected with the pin and further being engaged with the handle in at least the OFF position and the ON position by biasing the pin against the member at a location on the member that serves as an engagement location;

the connection point, the engagement location, and the pivot being aligned with one another at a toggle point of the mechanism between the ON position and the OFF position, the spring being structured to bias the mechanism toward the ON position when the engagement location is at a side of the toggle point, the spring being structured to bias the mechanism toward the OFF position when the engagement location is at another side of the toggle point.

10. The circuit interrupter of claim 9 wherein the latch is movable with respect to the housing and is situated in a position with respect to the housing in the OFF position and the ON position and wherein, responsive to a predetermined condition when the handle is retained in the ON position:

the latch moves away from the position;

the latch engages the pin and overcomes the bias of the spring to move the pin out of the notch, the bias of the spring moving the another pin to another location along the slot other than at the notch and thereby moving the engagement location to the another location to form another toggle point of the mechanism that includes the connection point, the pivot, and the another engagement location; and the contact arm moves from the ON position to a location at or beyond the another toggle point to cause the spring to move the circuit interrupter to the TRIP position.

11. The circuit interrupter of claim 10 wherein each mechanism of the number of mechanisms further comprises another spring and another pin, the another spring being connected with the handle and the another pin, the another pin being movable among one position engaged with the latch in at least one of the ON position and the OFF position and another position engaged with the handle in the TRIP position.

12. The circuit interrupter of claim 11 wherein:

the another spring biases the another pin into engagement with the latch in the OFF position and the ON position; and responsive to the predetermined condition when the handle is retained in the ON position:

the latch moving away from the position, and the another spring biasing the another pin out of engagement with the latch and into engagement with the contact arm and moving the contact arm from the ON position to the location at or beyond the another side of the toggle point.

13. The circuit interrupter of claim 12 wherein the handle comprises a lug and, when the handle is no longer retained in the ON position and is moved from the TRIP position to the OFF position:

the lug engages the another pin and overcomes the bias of the another spring to move the another pin back into engagement with the latch; and the another spring biases the another pin engaged with the latch to move the latch back to the position; and the pin moves along the slot to the notch and is biased by the spring into the notch.

14. The circuit interrupter of claim 13 wherein the number of mechanisms comprise a frame, the frame having formed therein another slot that is elongated and that has an end, the pin also being received in the another slot, the pin being engaged with the end during at least a portion of at least one of:

the moving of the pin along the slot to the notch; and the biasing of the pin into the notch by the spring.

15. A circuit interrupter movable among an ON position, an OFF position, and a TRIP position, comprising:

a housing;

a latch situated on the housing;

a pair of mechanisms situated on the housing, each mechanism of the pair of mechanisms comprising:

a contact arm that is movable with respect to the housing;

a set of separable contacts comprising a stationary contact and further comprising a movable contact situated on the contact arm;

a handle; and a spring that extends between the contact arm and the handle in at least one of the OFF position and the ON position;

the housing having a seat formed therein between the pair of mechanisms; and the latch having a base, the base being movably received in the seat, wherein each mechanism of the pair of mechanisms further comprises a trip apparatus that is cooperable with the latch, and wherein the latch further comprises a pair of struts connected with the base and situated at opposite sides of the base, each strut of the pair of struts comprising a leg that is cooperable with the trip apparatus of a corresponding mechanism of the pair of mechanisms.

16. The circuit interrupter of claim 15 wherein, for each mechanism of the number of mechanisms:

the contact arm comprises a first portion on which the movable contact is situated, a second portion having a connection point, and a pivot that is disposed on the housing and is situated between the first portion and the second portion;

an end of the spring being connected with the connection point, another end of the spring being engaged with the handle at an engagement location on the handle in the at least one of the OFF position and the ON position;

the connection point, the engagement location, and the pivot being aligned with one another at a toggle point of the mechanism between the ON position and the OFF position, the spring being structured to bias the mechanism toward the ON position when the engagement location is at a side of the toggle point, the spring being structured to bias the mechanism toward the OFF position when the engagement location is at another side of the toggle point.

17. The circuit interrupter of claim 16 wherein:

the latch is situated in a position with respect to the housing in the OFF position and the ON position;

the handle comprises a pin with which the spring is connected, the handle further comprising a member having formed therein a slot that is elongated and that includes a notch, the pin being situated in the slot and being biased by the spring against the member at a location on the member that serves as the engagement location, the pin being biased by the spring into the notch in the OFF position and the ON position;

each strut of the pair of struts comprising another leg that is cooperable with the pin of a corresponding mechanism of the pair of mechanisms; and responsive to a predetermined condition when the handle is retained in the ON position:

the latch moves away from the position; and the another leg engages the pin of the corresponding mechanism and overcomes the bias of the spring to move the pin out of the notch, the pin moving to another location along the slot other than at the notch and thereby moving the engagement location to the another location to form another toggle point of the mechanism that includes the connection point, the pivot, and the another engagement location.

18. The circuit interrupter of claim 17 wherein each mechanism of the pair of mechanisms further comprises:

another pin;

another spring that extends between the handle and the another pin;

the another pin being movable among one position engaged with a corresponding strut of the pair of struts in at least one of the ON position and the OFF position and another position engaged with the handle in the TRIP position; and responsive to the predetermined condition when the handle is retained in the ON position, the another spring biases the another pin out of engagement with the corresponding strut and into engagement with the contact arm of a corresponding mechanism and moves the contact arm from the ON position to a location at or beyond the another toggle point to cause the spring to move the circuit interrupter to the TRIP position.

* * * * *